United States Patent [19]

Kim et al.

[11] Patent Number: 4,999,541

[45] Date of Patent: Mar. 12, 1991

[54] PLASMA DISPLAY PANEL

[75] Inventors: Dae-il Kim; Woo-hyun Hwang, both of Kyunggi, Rep. of Korea

[73] Assignee: Samsung Electron Devices Ltd., Rep. of Korea

[21] Appl. No.: 398,504

[22] Filed: Aug. 25, 1989

[30] Foreign Application Priority Data

Jul. 28, 1989 [KR] Rep. of Korea ..... 89-10750

[51] Int. Cl.[5] ..... H01J 17/34

[52] U.S. Cl. ..... 313/584; 313/585; 313/590

[58] Field of Search ..... 313/584, 585, 590

[56] References Cited

U.S. PATENT DOCUMENTS 4,562,434 12/1985 Anano ..... 340/775

FOREIGN PATENT DOCUMENTS 59-37634 3/1984 Japan ..... 313/582

1137537 5/1989 Japan ..... 313/582

*Primary Examiner*—Sandra L. O'Shea

*Attorney, Agent, or Firm*—Leydig, Voit & Mayer

[57] ABSTRACT

A plasma display panel (PDP) is disclosed which is constituted such that cathodes and trigger electrodes are arranged in an X-Y matrix form on a rear plate, with insulating layers provided at the intersecting positions between the cathodes and the trigger electrodes, in such a manner that both the cathodes and the trigger electrodes should be exposed to the discharge spaced formed between a front plate and the rear plate. The PDP of the present invention is easy to manufacture and low in the manufacturing cost because the dielectric which is complicated and has fastidious conditions is removed, and a low cost metal can be used as the material for the electrodes.

1 Claim, 2 Drawing Sheets

PLASMA DISPLAY PANEL

FIELD OF THE INVENTION

The present invention relates to a plasma display panel, and particularly to a DC type plasma display panel in which the trigger electrodes and the cathode are exposed to the discharge space formed between the front plate and the rear plate and which is easy to manufacture and adequate in the response characteristics.

BACKGROUND OF THE INVENTION

Among the conventional plasma display panels (to be called hereinafter "PDP"), there is a trigger discharge type PDP of Sony corporation of Japan, which is disclosed in U.S. Pat. No. 4,562,434 and Japanese Laid-Open Patent publication No. Sho 58-30038 which are in turn schematically and extractively illustrated in FIGS. 1 and 2 respectively. This trigger discharge type PDP comprises a front plate Fa, a rear plate Ba, a plurality of X-Y matrix shaped anodes Aa and cathodes Da, and a plurality of separating walls Pa which are disposed between the respective anodes in direction parallel to the anodes Aa so as for the anodes to be separated one another.

Especially, the cathodes Ka disposed in the Y direction are separated from the inner side of the rear plate Ba by a dielectric insulating layer Ia, while trigger electrodes (or auxiliary anode) Ta are disposed between the insulating layer Ia and the rear plate Ba. The trigger electrode Ta,Ta' can be provided in a plurality of parallel strips like the cathodes Ka as shown in FIG. 1 or can be either provided in a single piece having the same size as that of the whole rear plate Ba s shown in FIG. 2.

Such a PDP is constructed such that a auxiliary discharge, i.e., a trigger discharge is generated before the occurrence of a main discharge for triggering the main discharge, and therefore, such a PDP has the advantages that the flickering at the initial stage of the main discharge is prevented, the response characteristics is markedly improved, and the realization of a high resolution image is made possible.

However, the above mentioned trigger discharge is generated through a medium of the dielectric insulating layer disposed between the trigger electrodes Ta and the cathodes Ka, and therefore, if the physical characteristics of the insulating layer is insufficient, then the product can not have the intended quality, thereby possibly leading to production of large quantities of defective products. The reason is that the insulating layer not only serves as the means for separating the cathodes Ka from the trigger electrodes Ta, but also as a means for depositing the wall charges which help to trigger the main discharge. In effect, a sternly precise dielectric constant is required for meeting the product quality and the design figures, while a high strength for withstanding against a voltage breakdown during the discharge is also required.

Further, in order to maintain high contrast ratio in said trigger discharge type PDP, the wall charge depositing region should be broadened so that satisfactory strength of trigger discharge can be obtained. For this purpose, the width of cathode should be formed as narrow as possible so as for the exposed width of dielectric layer to be formed relatively broadly. In this case, the contrast ratio may be raised. But brightness becomes relatively low because main discharge is lowered due to the decrease of the cathode width.

Meanwhile, in the manufacturing processes, a high precision work is also required, and particularly, the flatness of the trigger electrodes Ta should be kept above a predetermined level in order to prevent the concentration of charges on a particular region. Further, as the material of such trigger electrodes Ta, an organic metal paste having gold as the main ingredient is used, and therefore, the manufacturing cost of the product becomes very high.

SUMMARY OF THE INVENTION

Therefore it is the object of the present invention to provide a high resolution plasma display panel which can achieve high brightness and high contrast ratio and which is easy to manufacture, and low in the manufacturing cost.

In achieving the above object, the plasma display panel of the present invention comprises a front plate, a rear plate, a discharge space formed between the front plate and the rear plate, anodes attached to the front plate, cathodes attached to the rear plate and forming an X-Y matrix shape together with the anodes, and trigger electrodes for triggering main discharges between the cathodes and the anodes; and is characterized in that the cathodes and the trigger electrodes are arranged in X-Y matrix shape on the inner surface of the rear plate, non-conductive insulating layers are disposed at the positions where the cathodes and the trigger electrodes intersect each other, and the cathodes and the trigger electrodes are to be exposed to the discharge space formed between the front plate and the rear plate.

BRIEF DESCRIPTION OF THE DRAWINGS

The above object and other advantages of the present invention will become more apparent by describing the preferred embodiment of the present invention with reference to the attached drawings in which.

DESCRIPTION OF THE PREFERRED EMBODIMENT

Figure 1:
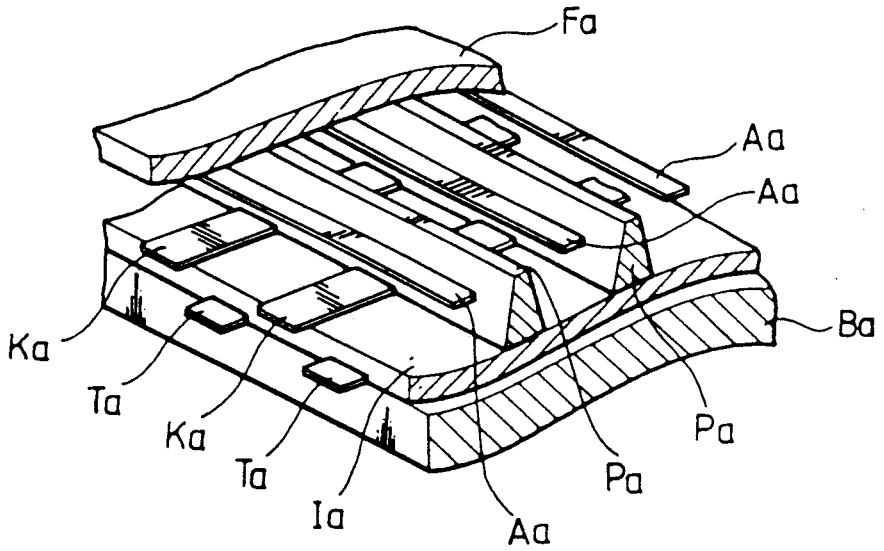
FIG. 1 (Prior Art)
FIGS. 1 and 2 are broken away perspective view of the conventional plasma display panels.
Figure 2:
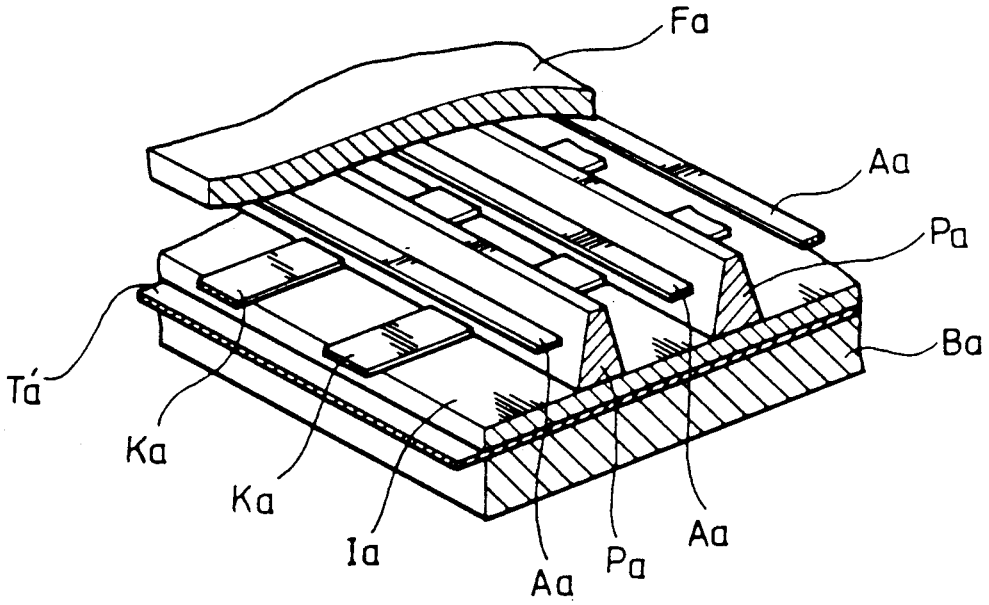
FIG. 2 (Prior Art)
Figure 3:
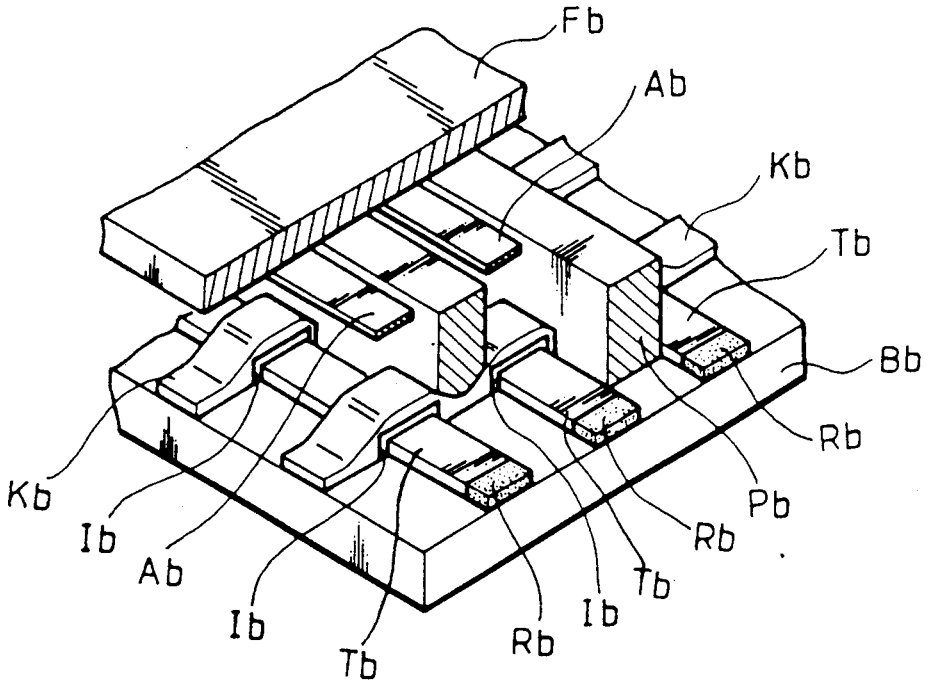
FIG. 3 is a broken away perspective view of the preferred embodiment of the present invention.

As shown in FIG. 3, a front plate Fb and a rear plate Bb form a discharge space therebetween, and X-Y matrix shaped anodes Ab and cathodes Kb are disposed in the said discharge space, the anodes Ab disposed in the X-direction being arranged in a stripe form on the inner surface of the front plate Fb, and the cathodes Kb disposed in the Y-direction being arranged on the rear plate Bb. Further, on the upper surface of the rear plate Bb which is disposed at the bottom of the cathodes Kb, trigger electrodes Tb are arranged in parallel one another at the same intervals as the anodes Ab and opposingly facing toward the anodes Ab, while, at the leading ends of the trigger electrodes Tb, thickly printed resistors Rb are respectively provided.

Meanwhile, at the intersecting positions between the cathodes Kb and the trigger electrodes Tb, insulating layers Ib made of a non-conductive material are provided in a bridge type in. order to prevent electrical conduction between the said two kinds of the electrodes. Therefore, the cathodes Kb and the trigger electrodes Tb form an X-Y matrix shape, while between the anodes and anodes and between the trigger electrodes and trigger electrodes, there are installed separating walls Pb for preventing cross talks between these electrodes.

The PDP of the present invention constituted as described above can be easily manufactured by a vacuum sputtering process, an etching process or a screen printing process while the low cost nickel is desirable as the material for the electrodes Ab,Kb,Tb and frit glass can be used as the material for the insulating layers Tb because the prevention of electrical conduction is enough regardless of dielectric constant.

Figure 4:
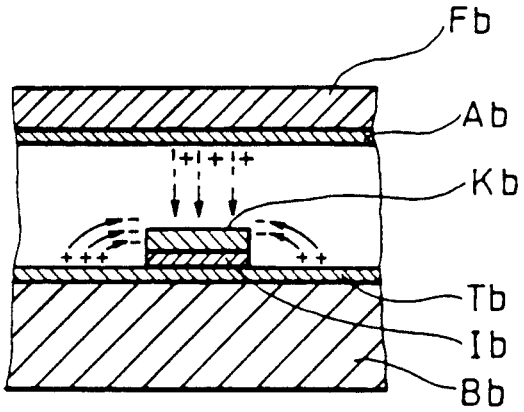
FIG. 4 is a a sectional view of the plasma display panel of FIG. 3.
Figure 5:
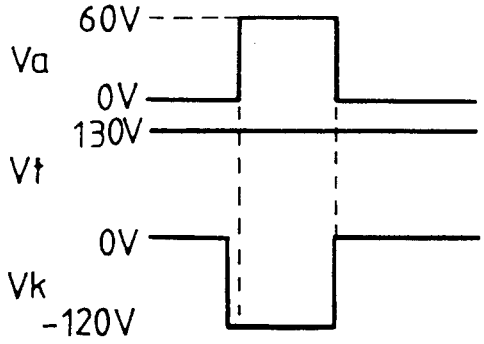
FIG. 5 illustrates the wave patterns of the driving voltages to be supplied to the plasma display panel of FIG. 3.

The PDP of the present invention can be driven by supplying, for example, pulse type voltages as shown in FIG. 5. If a trigger voltages Vt of +130 volts is always supplied to all the trigger electrodes Tb through the resistors Rb in accordance with the screening signals, and the cathode voltage Vk is shifted to a low (−120 volt) state in accordance with the horizontal and vertical synchronizing signals, then as shown in FIG. 4, firstly a space glow discharge (trigger discharge) will occur in the space between the trigger electrodes Tb and the cathode Kb. Then if the anode voltage Va is shifted to a high (+60 volts) state, then a main discharge is triggered and promoted due to the space charges accumulated in high concentration in the discharge space.

The above described trigger discharge between the trigger electrodes Tb and the cathodes Kb occurs through a discharge space filled with halogen gas, and therefore, as long as a voltage difference of a certain level is maintained between the cathodes and the trigger electrodes, the discharge continues in a sequential manner in accordance with the synchronizing pulses caused by the horizontal and vertical synchronizing signals so as to continuously assists the main discharges.

In the PDP according to the present invention which is driven by supplying pulse type voltages as described above since dielectric layer is not required as in the conventional Ac type PDP, high contrast ratio as well as high brightness is achieved compared with the conventional PDP. This is due to the fact that the trigger electrode can be formed with narrower exposed width and cathode can be formed with wider width to trigger the main discharge by means of the space charge due to the trigger discharge.

As described above, the PDP of the present invention is easy to manufacture because the dielectric which is complicated and has fastidious conditions is removed, and a low cost metal can be used as the material for the electrodes. Therefore, in addition, the manufacturing cost can be saved, and the unit price of the products can be lowered.

What is claimed is:

1. A plasma display panel comprising:

a front plate and a rear plate spaced to provide a discharge space between said front plate and said rear plate, anodes attached to said front plate, cathodes attached to said rear plate, said anodes and cathodes being arranged in an X-Y matrix, trigger electrodes arranged between said front plate and said rear plate in an X-Y matrix with said cathodes, and non-conductive insulation layers disposed at positions where said cathodes and said trigger electrodes intersect each other, said cathodes and said trigger electrodes being exposed to the discharge space between said front plate and said rear plate.

* * * * *